United States Patent [19]

Svanberg et al.

[11] Patent Number: 4,944,065

[45] Date of Patent: Jul. 31, 1990

[54] SUCTION CLEANER

[75] Inventors: Joakim A. Svanberg, Johanneshov; Lars G. Kilstrom, Täby; Lars G. Tuvin, Knivsta; Anders E. C. Larsson, Stockholm, all of Sweden

[73] Assignee: Aktiebolaget Electrolux, Stockholm, Sweden

[21] Appl. No.: 399,315

[22] Filed: Aug. 28, 1989

[30] Foreign Application Priority Data

Sep. 27, 1988 [SE] Sweden ..... 8803420

[51] Int. Cl.[5] ..... A47L 5/36

[52] U.S. Cl. ..... 15/327 C; 15/339

[58] Field of Search ..... 15/327 C, 344, 339

[56] References Cited

U.S. PATENT DOCUMENTS 1,255,662 2/1918 Sullivan ..... 15/327 C X 4,748,712 6/1988 DiGiovanni ..... 15/327 C

*Primary Examiner*—Chris K. Moore

*Attorney, Agent, or Firm*—Pearne, Gordon, McCoy & Granger

[57] ABSTRACT

A portable suction cleaner comprises a housing (10) with a filter bag (11) and a suction fan (12) driven by a motor (13). The suction cleaner is characterized in that the housing (10) is provided with a carrier belt (19) adapted to be applied around the bearer's waist or hips.

3 Claims, 2 Drawing Sheets

SUCTION CLEANER

BACKGROUND OF THE INVENTION

The present invention relates to a suction cleaner comprising a housing with a filter bag and a suction fan driven by a motor. In particular, the invention relates to a portable suction cleaner of this kind.

Portable suction cleaners are known which are carried by a strap on a shoulder. Suction cleaners provided with two shoulder straps are also known which are carried on the back like a rucksack. These known suction cleaners have a number of drawbacks, such as to load the spine and being difficult to put on, and in that the shoulder straps obstruct the arm movements of the user during the cleaning operation.

SUMMARY OF THE INVENTION

The object of the present invention is to provide a portable suction cleaner by which the above-mentioned drawbacks have been eliminated. This has been obtained by means of a suction cleaner of the kind mentioned in the introduction which according to the invention is characterized in that the housing is provided with a carrier belt adapted to be applied around the waist or hips of the user.

BRIEF DESCRIPTION OF THE DRAWINGS

The invention will be described in more detail below with reference to the accompanying drawing on which

DETAILED DESCRIPTION OF THE DRAWINGS

Figure 1:
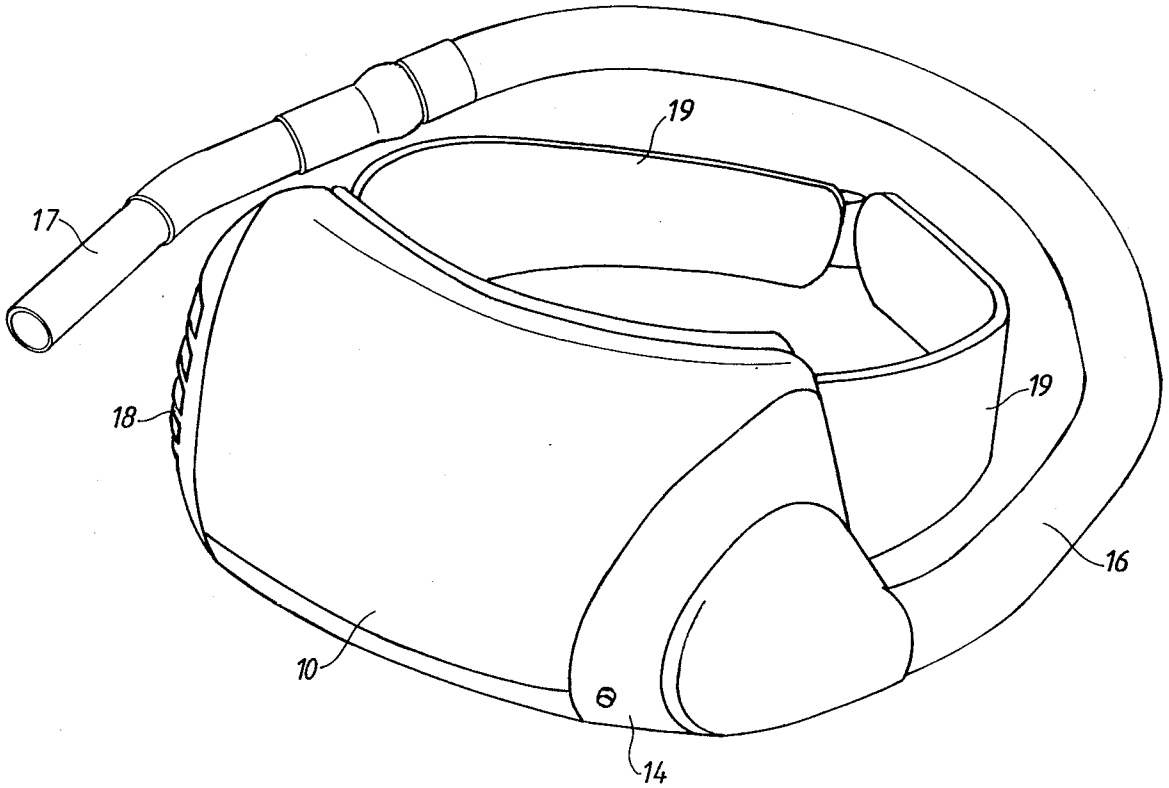
FIG. 1 is a perspective view of the suction cleaner according to the invention.

The suction cleaner illustrated in the drawings comprises a housing 10 with a filter bag 11 and a suction fan 12 driven by a motor 13. The housing has at one end thereof an openable cover 14 to which an inlet tube 15 is pivotally connected. The inlet tube 15 opens into the filter bag 11 and is connected to a suction hose 16 which, via a tube stick 17, is adapted to be connected to a suction cleaning tool (not shown). An air outlet 18 is provided at the other end of the housing.

The suction cleaner according to the invention is intended to be carried on the back at the level of the waist or hips, and to this end the housing 10 is provided with a carrier belt 19 which in the shown embodiment is made in two pieces. The free belt ends are releaseably and adjustably interconnectable by means of any suitable buckle, and the opposite belt ends are pivotably connected to the housing 10. The carrier belt is thereby easily adjustable to adapt to the figure and size of waist of the user in order to enable that the suction cleaner can be carried in a comfortable manner during the cleaning procedure.

Figure 2:
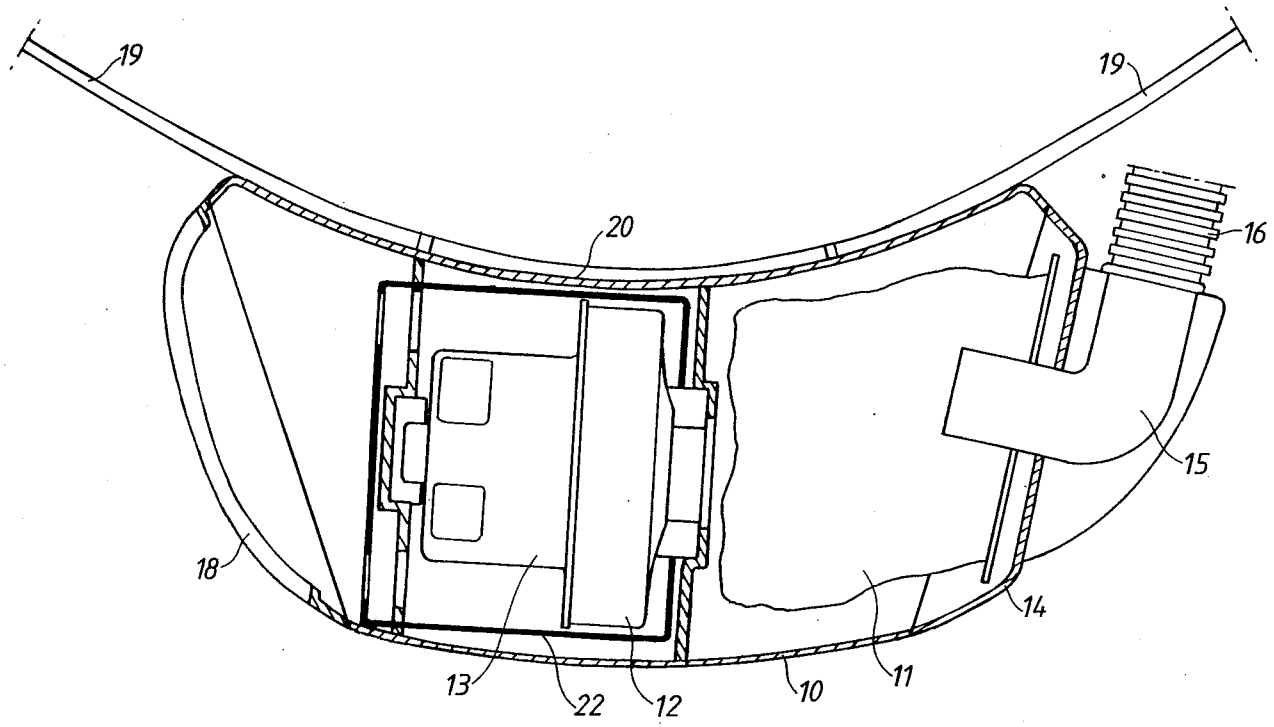
FIG. 2 is a diagrammatical longitudinal section of the suction cleaner in FIG. 1.

In order to facilitate the carrying still further the housing has been given a bent shape, and it is particularly important in this context that the side of the suction cleaner housing facing the bearer has a concave supporting surface 20 adapted to conform to the figure of the bearer, as is best shown in FIG. 2.

Electric motors generate and are surrounded by an electromagnetic field. Suction cleaners are now to a great extent made of plastic material penetratable to the electromagnetic radiation which in large doses can be unhealthy to the user. As appears from FIG. 2, the motor 13 and fan 12 are therefore surrounded by a cover 22 adapted to screen or reduce the radiation. The cover 2 is made of any material suitable for the intended purpose, such as steel sheet.

We claim:

1. Suction cleaner comprising a housing (10) with a filter bag (11) and a suction fan (12) driven by a motor (13), wherein the housing (10) is provided with a carrier belt (19) adapted to be applied around the waist or hips of the user, and that the housing (10) comprises a concave supporting surface (20) adapted to conform to the figure of the user.

2. Suction cleaner according to claim 1, wherein the carrier belt (19) is made in two pieces pivotably connected to the housing (10), the free ends of said belt pieces being releasably interconnectable.

3. Suction cleaner according to claim 2 wherein the carrier belt (19) is lockable at different angles in relation to the housing (10).

* * * * *